United States Patent [19]

Israel

[11] Patent Number: 4,796,395

[45] Date of Patent: Jan. 10, 1989

[54] SOLARIUM WITH MUNTINLESS EXTERIOR

[75] Inventor: Benjamin Israel, Huntingdon Valley, Pa.

[73] Assignee: Jardin, Inc., Southampton, Pa.

[21] Appl. No.: 1,591

[22] Filed: Jan. 8, 1987

[51] Int. Cl.[4] ..... E04B 7/18; E04B 7/02

[52] U.S. Cl. ..... 52/86; 52/90; 52/398

[58] Field of Search ..... 52/397, 200, 235, 460, 52/461, 462, 463, 464, 86, 395, 403, 398; 47/17

[56] References Cited

U.S. PATENT DOCUMENTS

| | | | |
|---|---|---|---|
| 705,372 | 7/1902 | Androvette | 47/17 |
| 1,024,113 | 4/1912 | Bennett | 52/395 |
| 1,070,434 | 8/1913 | Farquhar | 47/17 |
| 2,182,852 | 12/1939 | Mulford | 52/200 |
| 2,198,450 | 4/1940 | Chertkof | 52/200 |
| 2,624,427 | 1/1953 | Jacobs | 52/93 |
| 4,092,812 | 6/1978 | Dashner | 52/397 |
| 4,307,551 | 12/1981 | Crandell | 52/235 |
| 4,621,472 | 11/1986 | Kloke | 52/397 |
| 4,650,702 | 3/1987 | Whitmyer | 52/398 |
| 4,683,693 | 8/1987 | Rockar | 52/464 |
| 4,691,489 | 9/1987 | Shea | 52/398 |
| 4,738,065 | 4/1988 | Crandell | 52/235 |

*Primary Examiner*—John E. Murtagh
*Attorney, Agent, or Firm*—Michael F. Petock

[57] ABSTRACT

A solarium structure provides a muntinless exterior appearance by eliminating the outer retaining member of the horizontal muntins. The glazing panels are supported between an inner supporting member and an outer retaining member of the mullions and by the top and leg of an inner supporting horizontal muntin. The space between the glazing panels which overlies the legs of the T's of the substantially horizontal muntins is covered by a caulking material, which is preferably a silicone material.

13 Claims, 3 Drawing Sheets

SOLARIUM WITH MUNTINLESS EXTERIOR

BACKGROUND OF THE INVENTION

Solarium or greenhouse structures have become popular in recent years. The solarium or greenhouse structures have been utilized in numerous applications including, but not limited to, restaurant, deck, boat, pool and living structures. The glazing panels typically utilized are of insulated glass structures which are supported by a grid of mullions and muntins.

The exterior structure of the horizontal muntin presents a number of disadvantages and difficulties. The exterior structure of the horizontal muntin forms a retaining member which causes water, from rain or the like, to build up along the lower edges of the glass panels, particularly along the sloping portion of the solarium. This tends to result in leakage problems, particularly where there is any flaw in the caulking or sealing structure either as the result of a defect in the initial installation or due to deterioration over time.

A further and even more serious problem caused by the exterior structure of the horizontal muntin is that dirt builds up above the exterior portion of the horizontal muntin on the glazing surface, particularly as a result of the damming of the water. The damming of the water prevents the natural flushing away of this dirt during rainstorms. This results in the necessity of a worker periodically and regularly attending to the washing of the exterior glazing panels, particularly along the lower edges, immediately above the exterior horizontal muntin structures. This cleaning effort by the worker is often not easily performed due to the location, i.e. a sloping roof structure comprised of glass.

The exterior horizontal muntin structures furthermore provide a less pleasing external appearance.

SUMMARY OF THE INVENTION

The present invention solves the aforesaid problems encountered in the prior art by providing a solarium with a muntinless exterior.

The present invention provides a solarium without a muntin structure on the exterior of the glass thereby eliminating the dirt problem which builds up where the dirt and water collect at the lower end of the glazing panels, prevents leaks in this area which was previously prone to leakage problems and provides a much improved appearance which from a reasonable distance looks like a continuous vertical stretch of glazing material.

In accordance with the present invention, a solarium structure is provided which includes a framework for supporting and retaining glazing panels. The framework includes a plurality of mullions having substantially vertical portions, sloping portions and curved portions connecting the vertical portions with the sloping portions. The mullions have an inner supporting member and an outer retaining member. The framework further includes a plurality of substantially horizontal muntins. The horizontal muntins have an inner supporting member having a "T" cross-sectional shape with the leg of the "T" projecting outwardly and the top of the "T" being on the inside of the solarium structure. The glazing panels are supported between the inner supporting member and the outer retaining member of the mullions and on the inner supporting surfaces of the tops of the "T"s of said muntins and between the legs of the "T" shaped muntins. Caulking material, preferably of silicone, covers the space between the glazing panels and over the legs of the "T" of the substantially horizontal muntins.

The present invention further provides a solarium structure with an improved heat insulating structure eliminating direct heat loss through fasteners from the outer structure to the inner structure and vice versa.

BRIEF DESCRIPTION OF THE DRAWINGS

For the purpose of illustrating the invention, there are shown in the drawings forms which are presently preferred; it being understood, however, that this invention is not limited to the precise/arrangements and instrumentalities shown.

FIG. 5 is a cross-sectional view taken along line 5—5 of FIG. 1.

DESCRIPTION OF A PREFERRED EMBODIMENT

Figure 1:
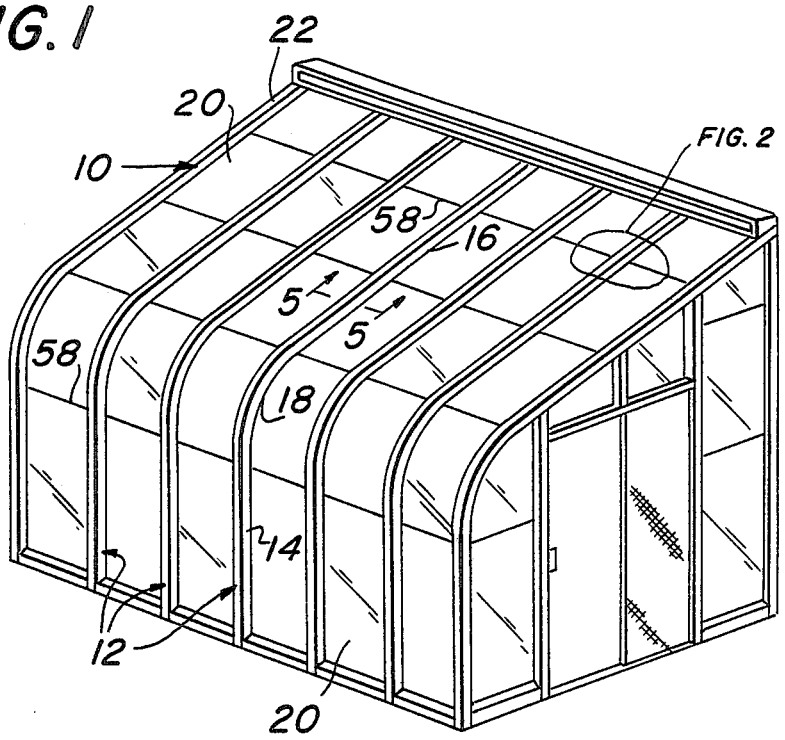
FIG. 1 is a view in perspective of a solarium structure in accordance with the present invention.

Referring to the drawings, wherein like numerals indicate like elements, there is shown in FIG. 1 a view in perspective of a solarium 10 in accordance with the present invention. Solarium 10 is provided with a plurality of mullions 12. Mullions 12 are comprised of vertical portions 14 and sloping portions 16 connected by curved portions 18. Glazing panels 20 are provided between the mullions. Glazing panels 20 may be comprised of any suitable glazing material, but are preferably comprised of double or triple panel insulated glass. Glazing panels 20 mounted between the curved portions 18 of mullions 12 are comprised of curved glass as is well known in the solarium art.

Figure 2:
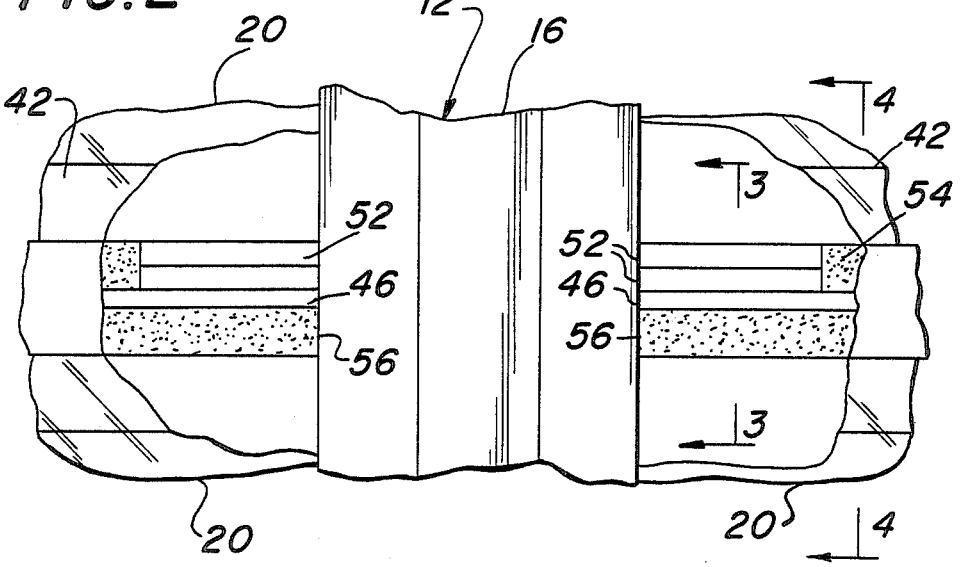
FIG. 2 is an elevation view, partially broken away, of a portion of a mullion at the intersection of a pair of muntins in accordance with the present invention.
Figure 3:
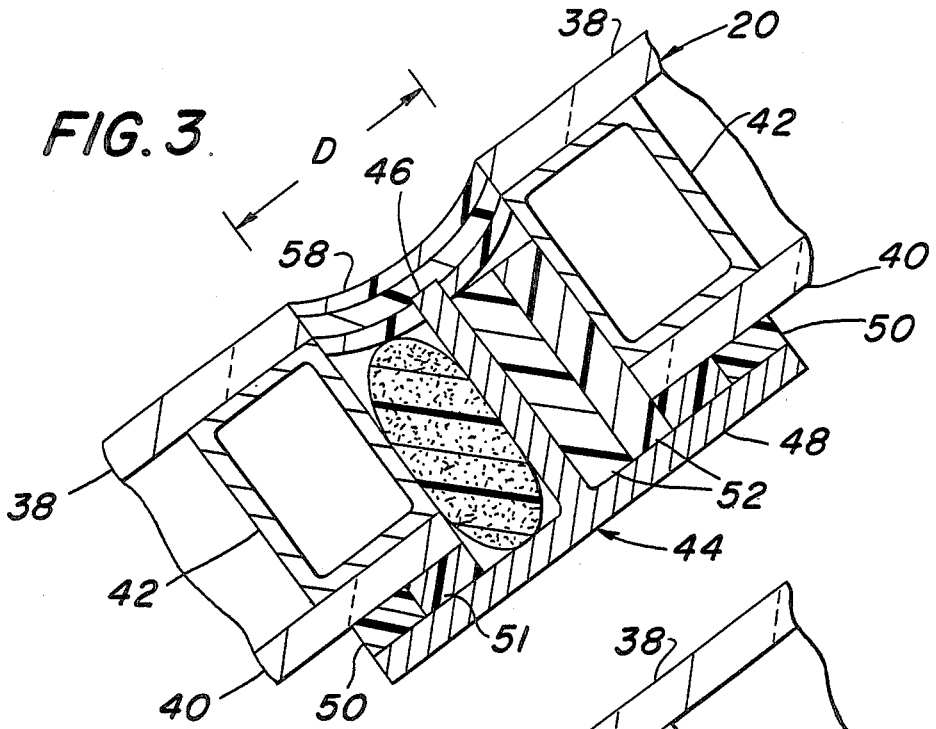
Figure 4:
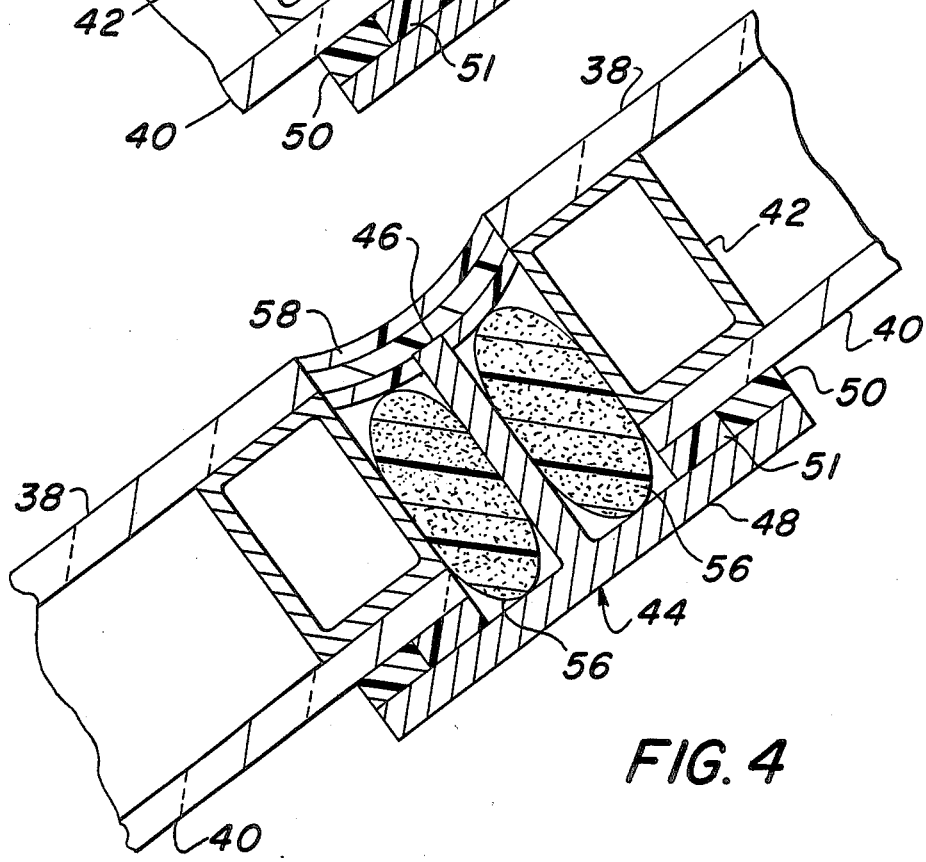
FIG. 4 is a cross-sectional view taken along line 4—4 of FIG. 2.
Figure 5:
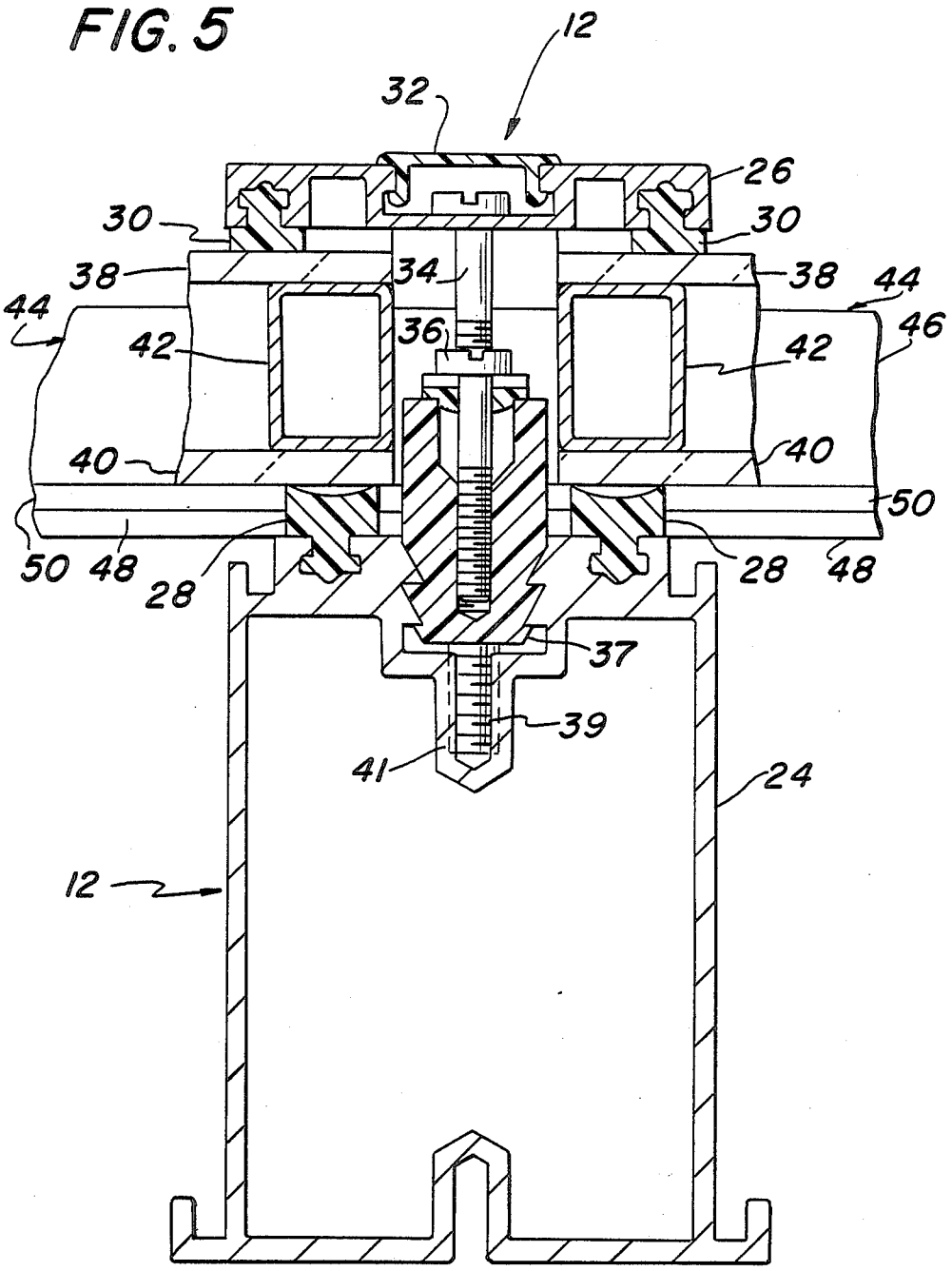
FIG. 5 is a cross-sectional view taken along line 3—3 of FIG. 2.

The exterior horizontal joints 22 between glazing panels 20 are without an exterior muntin structure as more clearly shown in FIGS. 2, 3 and 4. FIG. 5 more clearly illustrates the structure of mullions 12.

Referring now more particularly to FIGS. 2 through 5, the glazing panels 20 are shown to be mounted, particularly in FIG. 5, between an inner supporting member 24 and an outer retaining member 26 of mullion 12. Inner supporting member 24 and outer retaining member 26 are preferably constructed of aluminum, but may be made of other relatively rigid building materials well known in the art. Inner supporting member 24 is provided with a sealing gasket 28 and outer retaining member 26 is provided with a sealing gasket 30. Mullion 12 is also provided with an outer seal 32 which covers fasteners 34 and 36 which are utilized in connection with heat insulative retaining means 37 to hold outer retaining member 26 in a heat insulated manner to inner supporting member 24. Heat insulative retaining means 37 is preferably constructed of acrylonitrile-butadiene-styrene copolymer (ABS), but other suitable relatively rigid insulative materials may be utilized in practicing the invention. As may be more clearly seen in FIGS. 3 through 5, glazing panels 20 are preferably comprised of an outer glass pane 38 and an inner glass pane 40 which are held in a spaced insulating relationship by insulating spacer 42.

The horizontal interior muntin supporting structure 44 is preferably in the form of a "T" seen most clearly in FIGS. 3, and 5. The "T" is comprised of a leg 46 which projects outwardly and a top 48 which lies along the inside of the solarium 10. Muntin 44 is preferably constructed of aluminum, but other relatively rigid building materials may be utilized within the scope and spirit of the invention. Horizontal interior muntin 44 is preferably fastened to inner supporting member 24 of mullion 12 by a bolt fastener 39 securing horizontal muntin 44 through a hole in top (flange) 48 and threaded opening 41 of inner supporting member 24.

Glazing panels 20 are supported on the inverted "T" horizontal muntin 44. Preferably, the glass panels 20 are supported on inner glazing pads 50, preferably comprised of a glazing tape, lying between the inner panel 40 of glazing panel 20 and the top 48 of interior horizontal muntin 44. A silicone sealing material 51 is preferably utilized on the inside edge of tape 50 between inner panel 40 and the top 48 of the "T" muntin 44 as shown in FIGS. 3 and 4.

As may be seen by viewing FIGS. 2, 3 and 4, polyvinyl chloride spacer bars 52 are provided between the leg 46 of inner horizontal muntin 44 and the lower end of the insulated glazing panels 20. In between the polyvinyl chloride spacers 52 there is provided polyvinyl chloride foam rods 56. Polyvinyl chloride foam rods 56 are provided between the upper ends of glazing panels 20 and the legs 46 of interior horizontal muntins 44. Although spacers 52 and foam rods 56 are preferably constructed of polyvinyl chloride, the spacers and foam rods may be made of other suitable materials.

As more clearly shown in FIGS. 3 and 4, the space running in a horizontal direction between glazing panels 20 is partially filled and sealed with caulking material 58. The width "D" of this space as shown in FIG. 3 is preferably 0.375 inch, although greater or lesser dimensions may be utilized. The 0.375 inch width of this joint on a solarium structure having a vertical and sloping run of glazing panels typically extending for lengths greater than 15 feet presents as a fine line giving the appearance from a reasonable distance of a continuous sheet of glass or glazing material extending between the mullions. Caulking material 58 is preferably silicone. Caulking material 58 covers leg 46 of interior horizontal muntin 44 and the polyvinyl chloride spacers 52 and polyvinyl chloride foam rods 56. It is understood that other suitable materials may be utilized for caulking material 58 and the spacers and foam rods 52 and 56, respectively.

As may be seen from the structure described, heat transfer is significantly reduced in the structure of the present invention from outside to inside and vice versa by the elimination of direct heat flow paths along the fasteners as had been done in the past. In the past, the exterior aluminum structure was connected to the interior aluminum structure by a plurality, and often a large number of metal fasteners. Each metal fastener acted as a heat transfer path, with a large number of fasteners integrating to a significant heat loss path. The present invention eliminates the exterior horizontal muntin structure to provide a total heat insulating fastening relationship between the exterior and interior. This results in a significantly reduced heat loss factor for the supporting structure.

The present invention may be embodied in other specific forms without departing from the spirit or essential attributes thereof and, accordingly, reference should be made to the appended claims, rather than to the foregoing specification as indicating the scope of the invention.

I claim:

1. A solarium structure, comprising:

a framework for supporting and retaining a plurality of glazing panels, said glazing panels being comprised of at least two sheet panels of glass having a peripheral non-glass spacer therebetween to form an insulating space between the two panels of glass, at least one sheet panel comprising an outer sheet panel and at least one sheet panel comprising an inner sheet panel;

said framework including a plurality of mullions having substantially vertical portions, sloping portions and curved portions connecting said vertical portions with said sloping portions, said mullions having an inner supporting member and an outer retaining member;

said framework including a plurality of substantially horizontal inner muntins connected to said mullions, said muntins being comprised of a supporting member having a "T" cross-sectional shape with the leg of the "T" projecting outwardly, and the top of the "T" forming a pair of inner supporting surfaces for said glazing panels;

said glazing panels being supported between said inner supporting members and said outer retaining members of said mullions and on said inner supporting surfaces of the tops of the "T"s of said muntins and between the legs of said "T" shaped muntins;

said outer sheet of adjacent glazing panels juxtaposed the leg of said "T" shaped muntins being aligned and not overlapped to form an exterior surface in a single plane; and caulking material covering the space between glazing panels and over the legs of the "T" of said substantially horizontal muntins but not extending above the plane of the exterior surface of the glazing panels and whereby there is an absence of a conductive path between exterior and interior along said muntin.

2. A solarium structure in accordance with claim 1 wherein said framework includes a plurality of substantially vertical mullions having an inner supporting member and an outer retaining member.

3. A solarium structure in accordance with claim 1 wherein said caulking material is comprised of silicone.

4. A solarium structure in accordance with claim 1 wherein said caulking material has a width of 0.375 inch.

5. A solarium structure in accordance with claim 1 wherein spacer bars are provided between the lower end of the glazing panel and the leg of the "T" shaped muntin.

6. A solarium structure in accordance with claim 1 where in a polyvinyl chloride foam rod is provided between the glass panels and the leg of the "T" shaped muntin.

7. A solarium structure in accordance with claim 1 wherein the absence of exterior muntins in combination with inner supporting member and the outer retaining member of the mullions being fastened together by fasteners utilizing an insulative retaining means provides substantially total heat insulation between the outside and inside of the solarium structure.

8. A sloping solarium structure, comprising:

a framework for supporting and retaining a plurality of glazing panels, said glazing panels being comprised of at least two sheet panels of glass having a peripheral non-glass spacer therebetween to form an insulating space between the two panels of glass, at least one sheet panel comprising an outer sheet panel and at least one sheet panel comprising an inner sheet panel;

said framework including a plurality of mullions having a sloping portion, said mullions having an inner supporting member and an outer retaining member;

said framework including a plurality of substantially horizontal inner muntins connected to said mullions, said muntins being comprised of a supporting member having a "T" cross-sectional shape with the leg of the "T" projecting outwardly, and the top of the "T" forming a pair of inner supporting surfaces for said glazing panels;

said glazing panels being supported between said inner supporting members and said outer retaining members of said mullions and on said inner supporting surfaces of the tops of the "T"s of said muntins and between the legs of said "T" shaped muntins;

said outer sheet of adjacent glazing panels juxtaposed the leg of said "T" shaped muntins being aligned and not overlapped to form an exterior surface in a single plane; and caulking material covering the space between glazing panels and over the legs of the "T" of said substantially horizontal muntins but not extending above the plane of the exterior surface of the glazing panels and whereby there is an absence of a conductive path between exterior and interior along said muntin.

9. A sloping solarium structure in accordance with claim 8 wherein the absence of exterior muntins in combination with inner supporting member and the outer retaining member of the mullions being fastened together by fasteners utilizing an insulative retaining means provides substantially total heat insulation between the outside and inside of the solarium structures.

10. A sloping solarium structure in accordance with claim 8 wherein said caulking material is comprised of silicone.

11. A sloping solarium structure in accordance with claim 8 wherein said caulking material has a width of 0.375 inch.

12. A sloping solarium structure in accordance with claim 8 wherein spacer bars are provided between the lower end of the glazing panel and the leg of the "T" shaped muntin.

13. A sloping solarium structure in accordance with claim 8 wherein a polyvinyl chloride foam rod is provided between the glass panels and the leg of the "T" shaped muntin.

* * * * *

UNITED STATES PATENT AND TRADEMARK OFFICE

CERTIFICATE OF CORRECTION

PATENT NO. : 4,796,395

DATED : January 10, 1989

INVENTOR(S) : Benjamin Israel

It is certified that error appears in the above-identified patent and that said Letters Patent is hereby corrected as shown below:

Column 2, line 21, delete "5" and insert --3--.

Column 3, line 5, after "3," insert --4--.

Column 6, line 16, delete "structures" and insert --structure--.

Signed and Sealed this

Second Day of May, 1989

*Attest:*

*Attesting Officer*

DONALD J. QUIGG

*Commissioner of Patents and Trademarks*